US011976648B2

(12) United States Patent
Yamamoto et al.

(10) Patent No.: US 11,976,648 B2
(45) Date of Patent: May 7, 2024

(54) FLUID MACHINE

(71) Applicant: Hitachi Industrial Equipment Systems Co., Ltd., Tokyo (JP)

(72) Inventors: Akihiro Yamamoto, Tokyo (JP); Yoshiyuki Kanemoto, Tokyo (JP); Daichi Oka, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 17/269,101

(22) PCT Filed: Nov. 28, 2019

(86) PCT No.: PCT/JP2019/046499
§ 371 (c)(1),
(2) Date: Feb. 17, 2021

(87) PCT Pub. No.: WO2020/129564
PCT Pub. Date: Jun. 25, 2020

(65) Prior Publication Data

US 2021/0310479 A1 Oct. 7, 2021

(30) Foreign Application Priority Data

Dec. 20, 2018 (JP) ..... 2018-237868

(51) Int. Cl.
*F04B 49/10* (2006.01)
*F04B 49/08* (2006.01)
(Continued)

(52) U.S. Cl.
CPC ..... *F04B 49/103* (2013.01); *F04B 49/08* (2013.01); *F04C 14/28* (2013.01); *F04C 28/28* (2013.01);
(Continued)

(58) Field of Classification Search
CPC ..... F04B 49/08; F04B 2201/0801; F04B 2203/0205; F04B 2205/05; F04C 14/28;
(Continued)

(56) References Cited

U.S. PATENT DOCUMENTS 3,877,842 A * 4/1975 Greene ..... F04B 45/045 417/368
4,672,920 A * 6/1987 Duprez ..... H01H 37/36 340/451
(Continued)

FOREIGN PATENT DOCUMENTS

EP 1 253 321 A2 10/2002
JP 4-60360 A 2/1992
(Continued)

OTHER PUBLICATIONS

International Search Report (PCT/ISA/210) issued in PCT Application No. PCT/JP2019/046499 dated Mar. 3, 2020 with English translation (five (5) pages).
(Continued)

*Primary Examiner* — Christopher S Bobish
(74) *Attorney, Agent, or Firm* — Crowell & Moring LLP

(57) ABSTRACT

Even when abnormal heat generation occurs during operation in a state where the temperature of a compressor is not increased, abnormality cannot be detected. A fluid machine includes a fluid machine body; a motor that drives the fluid machine body; a temperature sensor that measures a temperature of the fluid machine body; and a control unit that controls the fluid machine body. The control unit changes a temperature threshold value based on at least one of a pressure of a fluid discharged by the fluid machine body and a frequency of a voltage input into the motor, and issues a
(Continued)

notification when the temperature of the compressor body measured by the temperature sensor exceeds the temperature threshold value.

9 Claims, 11 Drawing Sheets

(51) Int. Cl.
*F04C 14/28* (2006.01)
*F04C 28/28* (2006.01)

(52) U.S. Cl.
CPC ..... *F04B 2201/0801* (2013.01); *F04B 2203/0201* (2013.01); *F04B 2203/0202* (2013.01); *F04B 2203/0205* (2013.01); *F04B 2205/05* (2013.01); *F04C 2270/19* (2013.01); *F04C 2270/44* (2013.01)

(58) Field of Classification Search
CPC ... F04C 28/28; F04C 2270/19; F04C 2270/44
See application file for complete search history.

(56) References Cited

U.S. PATENT DOCUMENTS 4,743,176 A * 5/1988 Fry ..... F04B 39/06 62/505
5,542,395 A * 8/1996 Tuckey ..... F02D 41/3082 123/497
5,627,417 A * 5/1997 Clarke ..... F04B 49/02 307/141
5,653,125 A * 8/1997 Boyanich ..... F25B 31/006 417/372
6,036,449 A * 3/2000 Nishar ..... B60K 25/00 417/292
6,799,950 B2 * 10/2004 Meier ..... F04B 49/02 417/32
7,908,875 B2 * 3/2011 Smith ..... F25B 49/005 62/157
8,668,042 B2 * 3/2014 Elliott ..... F16H 61/46 180/339
8,845,301 B2 * 9/2014 Smith ..... F04B 39/06 417/44.1
9,243,627 B2 * 1/2016 Engelhardt ..... F04B 49/02
9,790,944 B2 * 10/2017 Yano ..... F04D 13/06
10,563,650 B2 * 2/2020 Kato ..... F02D 35/0007
2002/0187048 A1 12/2002 Meier et al.
2004/0013530 A1 * 1/2004 Kelly ..... F04C 28/28 417/32
2010/0303637 A1 * 12/2010 Engelhardt ..... F04B 49/02 417/32

FOREIGN PATENT DOCUMENTS

JP 4-109085 A 4/1992
JP 6-213171 A 8/1994
JP 2007-205206 A 8/2007
JP 2008-31965 A 2/2008

OTHER PUBLICATIONS

Japanese-language Written Opinion (PCT/ISA/237) issued in PCT Application No. PCT/JP2019/046499 dated Mar. 3, 2020 (five (5) pages).
Partial European Search Report issued in European Application No. 19898545.9 dated Nov. 30, 2022 (12 pages).

* cited by examiner

| PRESSURE / FREQUENCY | 0～0.2 [MPa] | 0.2～0.4 [MPa] | 0.4～0.6 [MPa] | 0.6～0.8 [MPa] | 0.8～1.0 [MPa] |
|---|---|---|---|---|---|
| 200～250Hz | 35K | 40K | 45K | 50K | 55K |
| 250～300Hz | 30K | 35K | 40K | 45K | 50K |

FLUID MACHINE

TECHNICAL FIELD

The present invention relates to a fluid machine.

BACKGROUND ART

There is known a gas compressor that generates compressed gas used as a power source of a production line or an air source for a machine tool, a press machine, an air blower, or the like. The gas compressor includes a compressor body that compresses the gas in a compression chamber formed by a casing, and is configured to discharge the compressed gas from a discharge port to a gas tank via a discharge pipe. In addition, there is a package-type gas compressor in which a compressor body, a motor that drives the compressor body, a control circuit, an operation panel, and the like are integrated into a package to save space. In such a gas compressor or other fluid machines having the same configuration, in order to extend the product life, it is necessary to detect wear of the fluid machine body and to then perform maintenance before occurrence of damage.

There is Patent Document 1 as the background art of the present invention. In Patent Document 1, cooling fans 23 and 24 that are driven together with a compressor body 3 by a motor 18, an unload mechanism 25 that switches the compressor body 3 between a normal operation and a no-load operation, and a temperature sensor 36 that measures the ambient temperature of the compressor body 3 as an in-box temperature T1 are provided inside a soundproof box 1. When the in-box temperature T1 exceeds an upper limit temperature H, the compressor body 3 is switched to the no-load operation by a CPU 38 or the like, and when the in-box temperature T1 is a return temperature L or less, the compressor body 3 returns to the normal operation. Accordingly, during no-load operation, control is performed such that the temperature inside the soundproof box 1 can be decreased by the cooling fans 23 and 24 while the heat generation amount of the compressor body 3 is suppressed, and a malfunction of a thermal relay 34 and the like caused by high temperature can be prevented.

CITATION LIST

Patent Document

Patent Document 1: JP 2008-31965 A

SUMMARY OF THE INVENTION

Problems to be Solved by the Invention

In a compressor described in Patent Document 1, the temperature determined to be abnormal in an operating state where the heat generation amount is large is set to the upper limit temperature H, and for example, even when abnormal heat generation occurs during operation in a state where the temperature of the compressor is not increased, such as during operation in a low pressure state or when the rotation speed is controlled at high speed by an inverter, abnormality cannot be detected.

Solutions to Problems

In order to solve the above problem, there is provided a fluid machine including: a fluid machine body; a motor that drives the fluid machine body; a temperature sensor that measures a temperature of the fluid machine body; and a control unit that controls the fluid machine body. The control unit is configured to change a temperature threshold value based on at least one of a pressure of a fluid discharged by the fluid machine body and a frequency of a voltage input into the motor, and to issue a notification when the temperature of the compressor body measured by the temperature sensor exceeds the temperature threshold value.

Effects of the Invention

According to the present invention, even during operation in a state where the temperature is not increased, abnormal heat generation can be detected.

MODE FOR CARRYING OUT THE INVENTION

First Embodiment

In the present embodiment, as a compression method of a compressor body, a scroll compressor in which a compression chamber is formed between a fixed scroll and an orbiting scroll and which takes orbiting motion to compress air will be described as an example.

Figure 1:
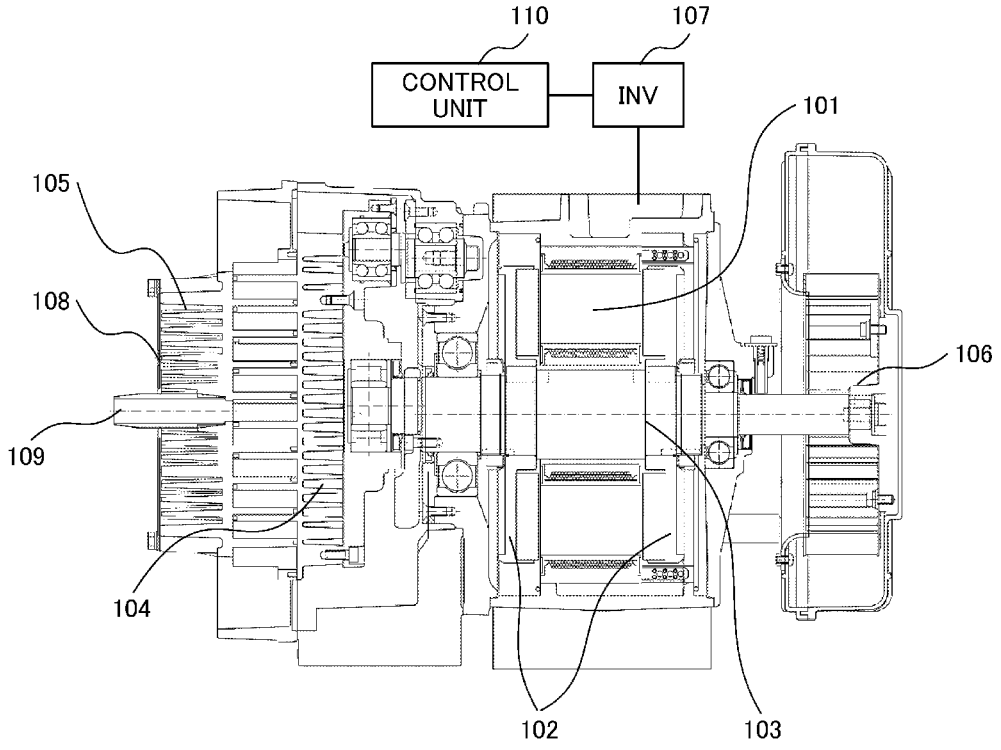
FIG. 1 is a cross-sectional view of a compressor body of one embodiment of the present invention.

FIG. 1 is a cross-sectional view of the compressor body in the present embodiment. In the compressor illustrated in FIG. 1, power is transmitted from a motor including a stator 101 and a rotor 102 to the compressor including an orbiting scroll 104 and a fixed scroll 105 via a shaft 103. The rotation speed of the motor changes at the frequency of voltage output from an inverter 107. The power from the shaft 103 is transmitted to a cooling fan 106, and the cooling fan 106 delivers generated cooling air to cooling fins of the orbiting scroll 104 and the fixed scroll 105 via a duct (not illustrated) to cool the compressor. A temperature sensor 108 is disposed at a distal end of the cooling fin of the fixed scroll 105, and uses a measured temperature to detect abnormality of the compressor and to issue a notification when the abnormality is detected.

Temperature information measured by the temperature sensor 108 or a temperature sensor 109 provided in the compressor body, or information such as a current value measured by an ammeter provided in the inverter 107 is input to a control unit 110. The frequency of voltage output from the inverter 107 is controlled by the control unit.

Figure 2A:
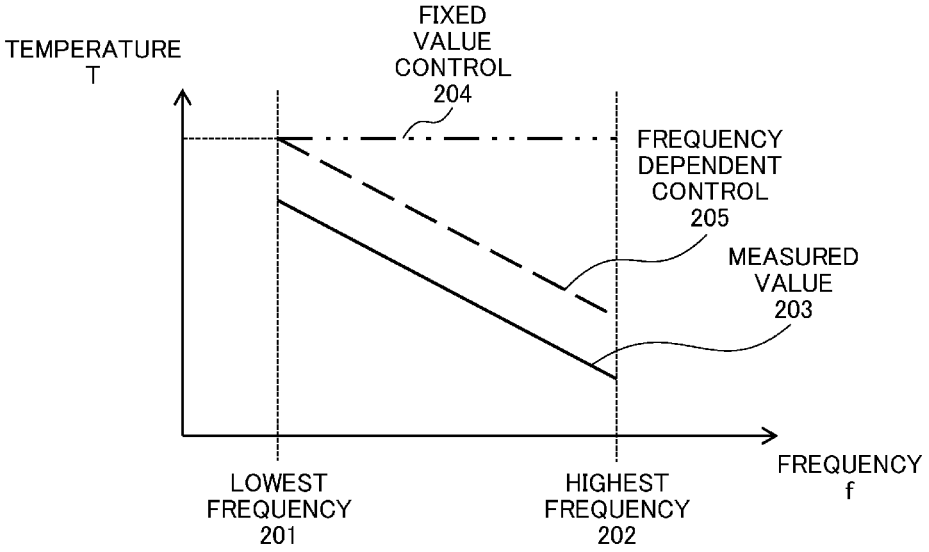
FIGS. 2A and 2B are schematic graphs of a relationship between frequency and temperature and a relationship between pressure and temperature in a first embodiment of the present invention.
Figure 2B:
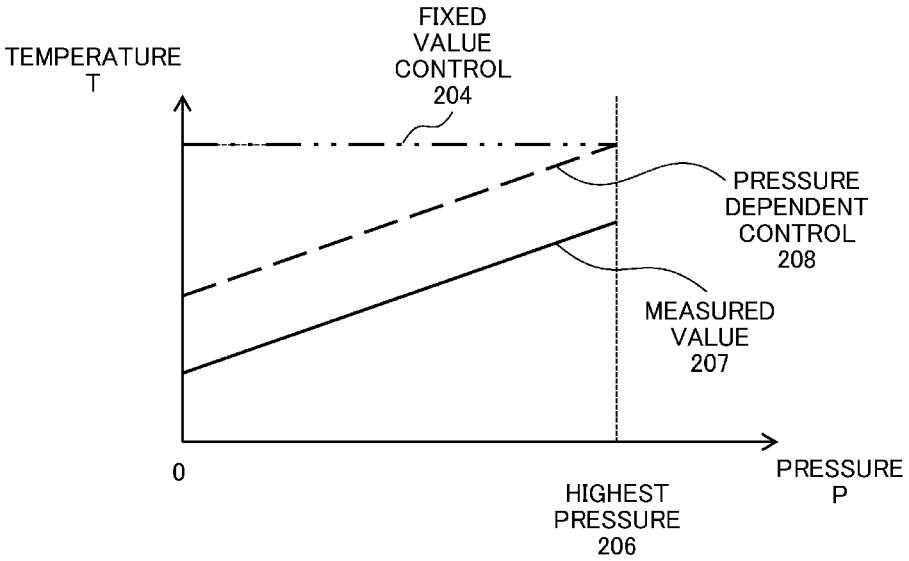

FIG. 2 is schematic graphs of a relationship between the frequency of voltage output from the inverter 107 and temperature measured by the temperature sensor 108, and a relationship between pressure discharged from the compressor and the temperature measured by the temperature sensor 108 in the first embodiment. FIG. 2A shows a relationship between a frequency f and a temperature T, and FIG. 2B shows a relationship between a pressure P and the temperature T.

As shown in FIG. 2A, the frequency f changes between a lowest frequency 201 and a highest frequency 202 such that pressure is constant when the air amount of compressed air to be discharged is changed. When the frequency f decreases, the rotation speed of the cooling fan rotating on the shaft 103 similar to the compressor decreases, so that the air amount of cooling air decreases and accordingly, the temperature T of the compressor rises. The relationship changes as indicated by 203, and when the frequency f decreases, the temperature T of the compressor rises.

In addition, the relationship between the pressure P and the temperature T is as shown in FIG. 2B, and the pressure changes from 0 MPa to a highest pressure 206. When the pressure P increases, the temperature of the fixed scroll 105 rises with a rise in temperature of the compressed air, and the temperature T also rises. A product in the related art controls a threshold value with respect to the frequency f and the pressure P to a fixed value as indicated by 204. For this reason, there is a possibility that even when the frequency f increases or the pressure decreases, the product in the related art cannot detect abnormality until the temperature rises to 204, and there is a delay in dealing with abnormality occurring in the compressor. For this reason, the threshold value is made to depend on the frequency and the pressure as indicated by 205 and 208, and control is performed such that abnormality can be detected early.

A method for determining a threshold value T(f) corresponding to the frequency f is represented by equation (1) where the threshold value is a value obtained by adding a constant value to a normal temperature To(f), equation (2) where the threshold value is expressed as a function of the frequency f using arbitrary coefficients k and β, or the like, and more generally, may be represented by equation (3).

$$T(f)=To(f)+\alpha \tag{1}$$

$$T(f)=-kf+\beta \tag{2}$$

$$T(f+\Delta f)\geq T(f)(\Delta f>0) \tag{3}$$

A method for determining a threshold value T(P) corresponding to the pressure P is represented by equation (4) where the threshold value is a value obtained by adding a constant value to a normal temperature To(P), equation (5) where the threshold value is expressed as a function of the pressure P using arbitrary coefficients m and β, or the like, and more generally, may be represented by equation (6).

$$T(P)=To(P)+\alpha \tag{4}$$

$$T(P)=mP+\beta \tag{5}$$

$$T(P+\Delta P)\leq T(P)(\Delta P>0) \tag{6}$$

Figure 3A:
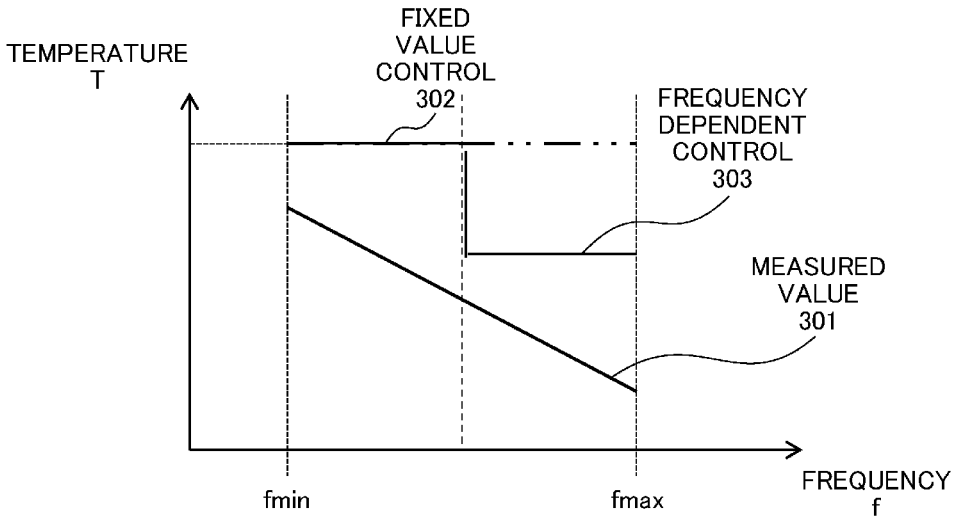
FIGS. 3A and 3B are schematic graphs in which threshold values are added to the relationship between frequency and temperature and the relationship between pressure and temperature in the first embodiment of the present invention.
Figure 3B:
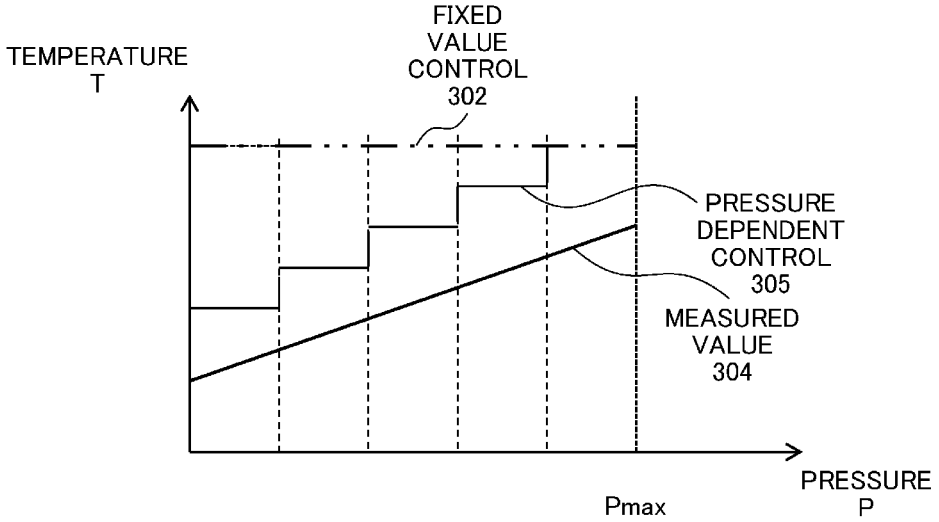

In FIG. 3, the methods for determining the threshold values shown in FIG. 2 are simplified. In methods for determining threshold values shown in FIG. 3, the frequency and the pressure each are divided into ranges, and the threshold values each are changed to constant threshold values in a stepwise manner for each range as indicated by 303 and 305. Threshold values 303 and 305 are larger than the values of normal temperatures 303 and 304. When the range is divided, the size of the range may be divided according to a portion even in a certain range. In addition, the number of divisions is also arbitrary.

Figures 4, 5:
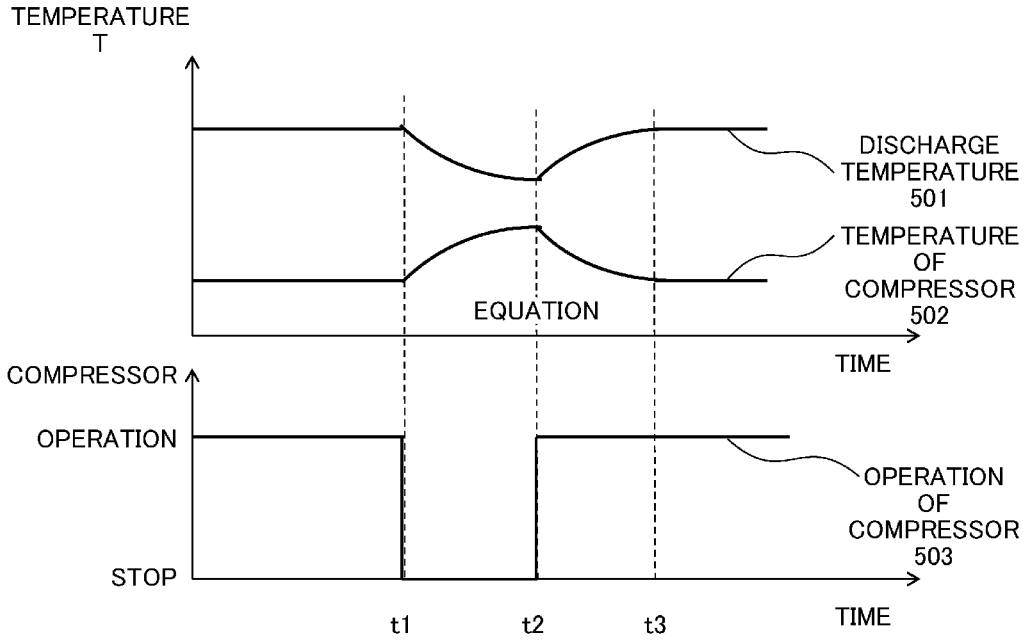
FIG. 4 is a threshold value map in the first embodiment of the present invention.
FIG. 5 shows temperature values when a compressor is operated and stopped in the first embodiment.

In FIG. 4, the threshold values of the temperature are mapped with respect to the pressure and the frequency. When the threshold value is actually determined, the threshold value is required to be determined based on both the pressure and the frequency, so that the threshold value within the range of each pressure and frequency is used as a value for determining temperature abnormality. When the frequency or the pressure changes, the threshold value is accordingly changed. For example, when an operation is performed at a frequency of 260 Hz and a pressure of 0.5 MPa, the threshold value is 40 K. When the frequency does not change from this point and the pressure rises to 0.65 MPa, the threshold value is changed to 45 K and a determination is performed. Here, the unit Kelvin (K) is a measured temperature which is relative to the ambient temperature (air temperature) of the compressor, and in the case of 30 K, the measured temperature is 30° C. higher than the ambient temperature.

FIG. 5 shows a relationship between a temperature of the compressor 502 when temperature is measured in a portion of 108 in FIG. 1, a discharge temperature 501, and an operating state of the compressor 503. In a period from t1 to t2 in FIG. 5 for which the compressor is stopped, since gas is not compressed, the discharge temperature 501 decreases, but the temperature of the compressor 502 rises due to heat transfer from the highest temperature location inside the compressor since the cooling fan 106 is stopped. When an operation starts at t2, the discharge temperature rises again and the temperature of the compressor is cooled by the cooling fan, so that the temperature decreases. However, it takes up to t3 for the temperature to decrease until the operation is continuously performed. Namely, it is normal that the temperature in a period from t1 to t3 is higher than that in a steady state, and when a determination on temperature abnormality is performed in the range, the temperature may exceed the threshold value. For this reason, in the present embodiment, a determination is not performed in the range from t1 to t3.

Figure 6:
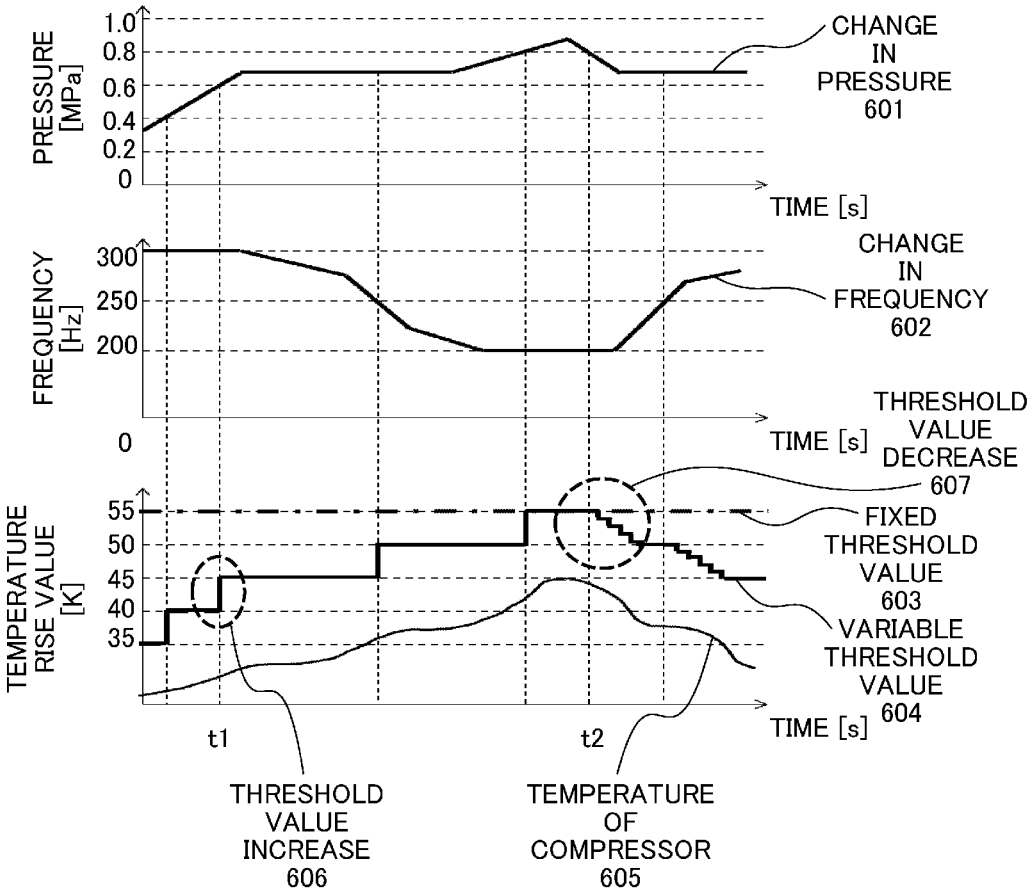
FIG. 6 shows a change in threshold value when the frequency and the pressure change in the first embodiment.

FIG. 6 shows a graph of time change of a relationship between a temperature rise value 605 of the compressor and a threshold value 604 when a pressure 601 and a frequency 602 change. The amount of a change in threshold value is adjusted depending on whether the threshold value is increased or decreased, so that the possibility of erroneous detection can be reduced.

In this control, when the threshold value is increased as at time t1, since the threshold value is a threshold value of 45 K at time t1 as indicated by a threshold value increase 606, the threshold value is immediately increased to 45 K. On the other hand, when the threshold value is decreased as at time t2, control is performed such that as indicated by threshold value decrease 607, the threshold value is not immediately decreased to a threshold value of 50 K at time t2, but the threshold value is decreased over time in a stepwise manner, linearly, or non-linearly. The reason is that since it takes time for the temperature of the compressor to decrease, when the threshold value is immediately decreased, there is a possibility of detecting abnormality of the compressor even though there is no abnormality.

Figure 7:
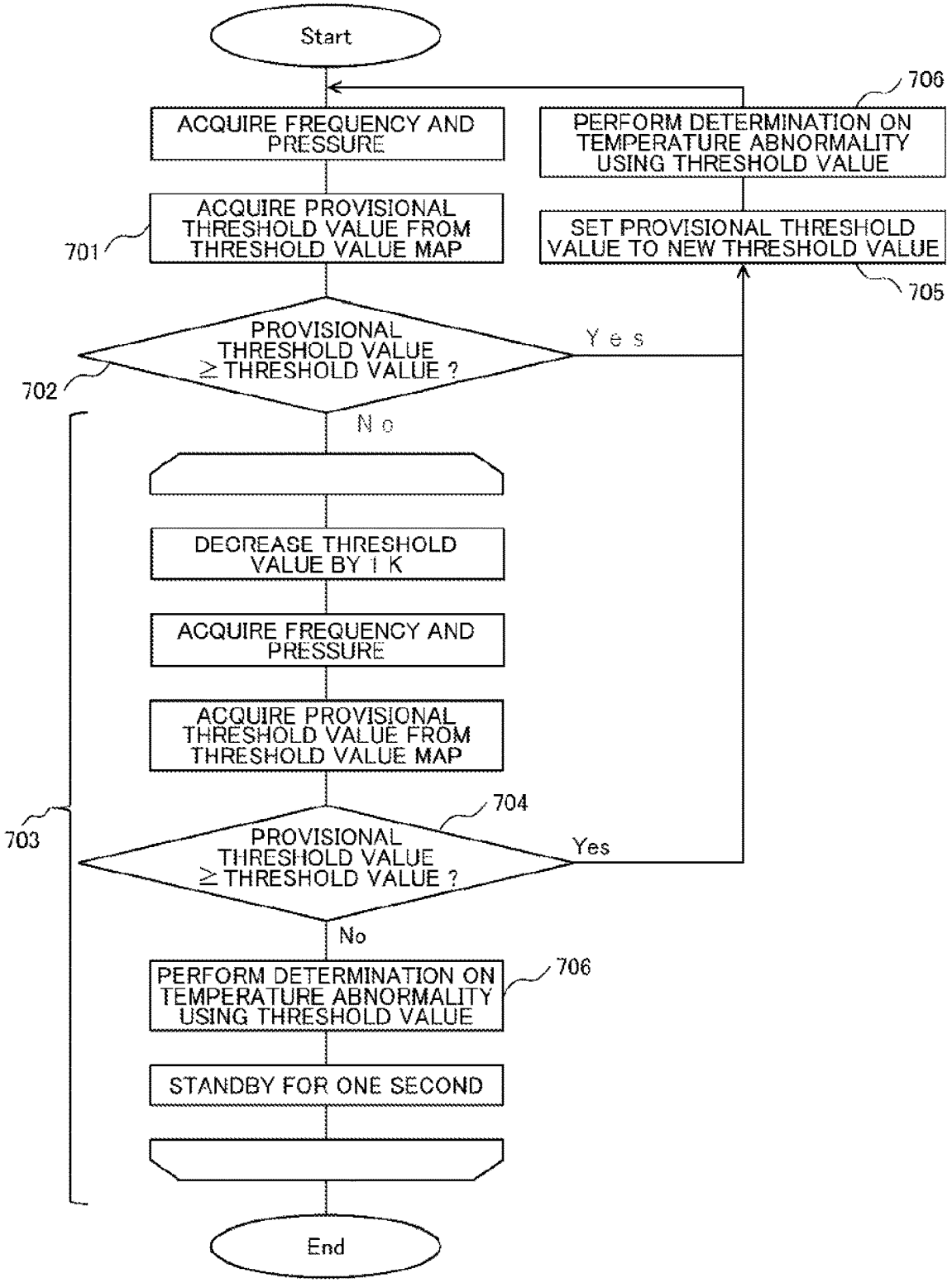
FIG. 7 is a sequence chart to determine a threshold value in the first embodiment.

FIG. 7 is a flowchart to determine temperature abnormality of the compressor. After the frequency and the pressure are acquired, at step 701, a provisional threshold value is acquired from the threshold value map shown in FIG. 4. When the provisional threshold value is larger than a current threshold value at step 702, a temperature abnormality determination 706 is performed with the provisional threshold value set to a new threshold value 705. When the provisional threshold value is smaller than the threshold value at step 702, a determination 706 is performed while the threshold value is decreased by 1 K at certain time intervals up to the provisional threshold value as at step 703. If a pressure rise or a frequency decrease occurs in the middle of step 703 and the provisional threshold value is larger than the threshold value in the determination at step 704, the process of decreasing the threshold value by 1 K at the certain time intervals up to the provisional threshold value is stopped, and a determination on temperature abnormality is performed with the provisional threshold value set to the threshold value.

Since the threshold value is not set to a fixed value and is changed according to the pressure and the frequency as described above, the accuracy of detecting a temperature rise caused by wear of the compressor is further improved, and maintenance can be performed before damage occurs due to the wear of the compressor.

In FIG. 7, the method for using the threshold value map to acquire the threshold value is adopted; however, when a method for acquiring the threshold value by calculation is adopted, the provisional threshold value is calculated at step 701 and a third step of step 703 of acquiring the provisional threshold value, so that the same control can be performed.

Incidentally, in the present embodiment, the inverter machine has been described as a target; however, a compressor which is subjected to constant speed control without using the inverter may be used, and in that case, only the threshold value is changed for a change in pressure, so that similarly, a determination can be performed with high detection accuracy.

In addition, in the present embodiment, an example where the threshold value is changed according to the pressure and the frequency has been described; however, the threshold value can be changed according to only the pressure or only the frequency.

Second Embodiment

Figure 8:
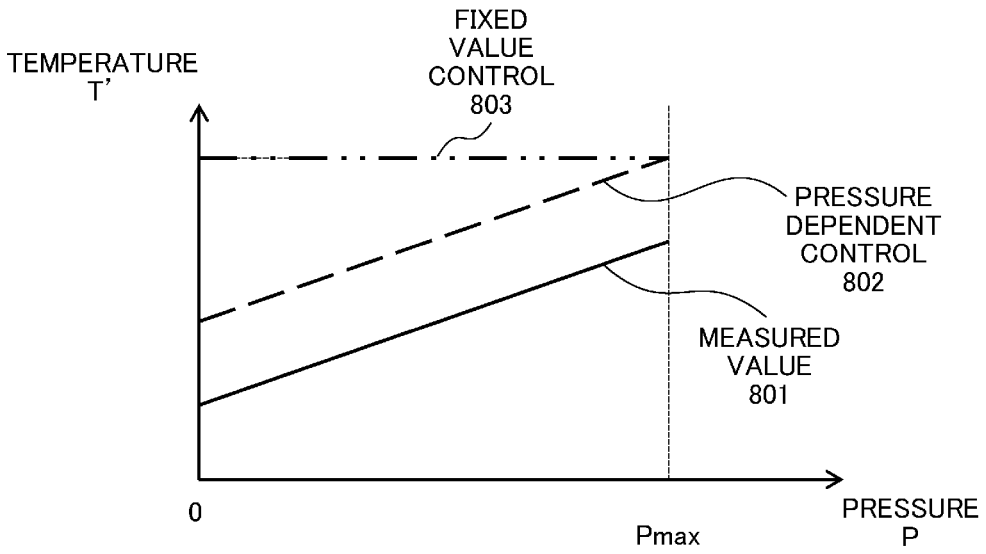
FIG. 8 is a schematic graph in which a threshold value is added to a relationship between pressure and temperature in a second embodiment.

FIG. 8 shows the discharge temperature of the compressor when pressure changes, the discharge temperature being measured in a discharge port for the compressed gas by the temperature sensor 109 in FIG. 1. The discharge temperature depends on the pressure, and when the pressure increases, the discharge temperature also increases. A method for determining a threshold value T'(P) of 802 corresponding to the pressure P is represented by equation (7) where the threshold value is a value obtained by adding a constant value to a normal temperature To'(P) of 801, equation (8) where the threshold value is expressed as a function of the pressure P using the arbitrary coefficients m and β, or the like, and more generally, may be represented by equation (9).

$$T'(P)=To'(P)+\alpha \tag{7}$$

$$T'(P)=mP+\beta \tag{8}$$

$$T'(P+\Delta P)\geq T'(P)(\Delta P>0) \tag{9}$$

Figure 9:
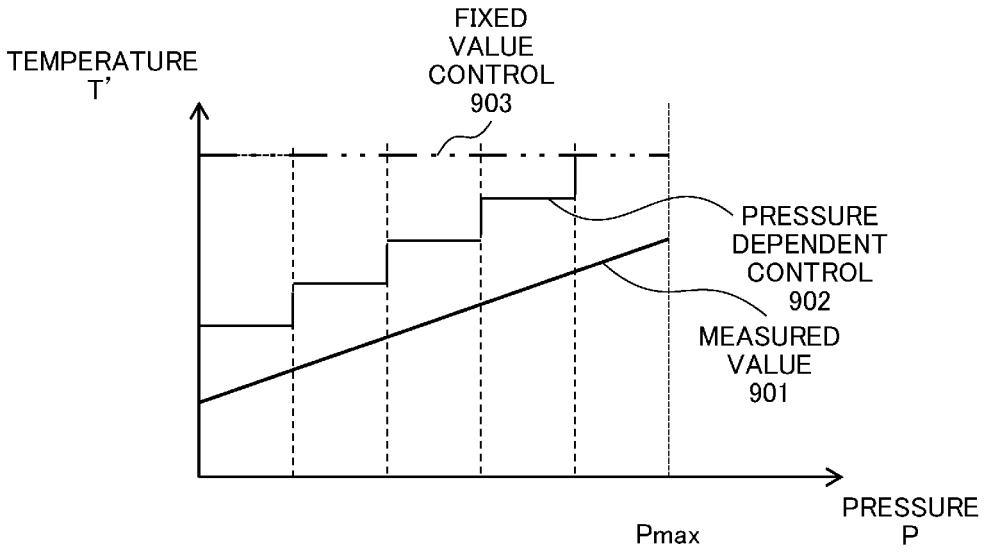
FIG. 9 is a schematic graph in which a threshold value is added to the relationship between pressure and temperature in the second embodiment.

In FIG. 9, the method for determining the threshold value shown in FIG. 8 is simplified similar to FIG. 3. In the method for determining the threshold value shown in FIG. 9, the pressure is divided into ranges, and the threshold value is set to a constant threshold value for each range as indicated by 902. A threshold value 902 is larger than the value of a normal temperature 901. When the range is divided, the size of the range may be divided according to a portion even in a certain range. In addition, the number of divisions is also arbitrary.

Figure 10:
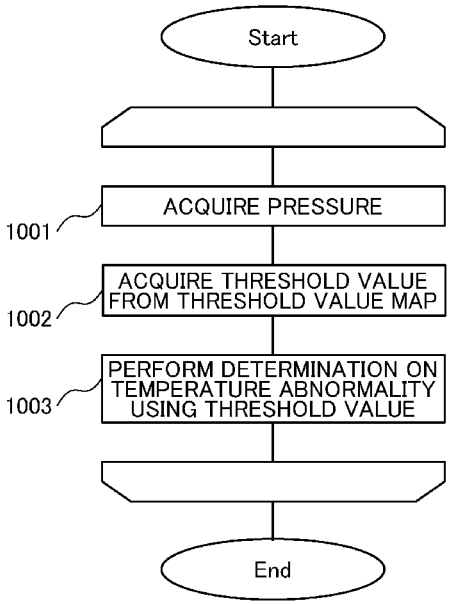
FIG. 10 is a sequence chart to determine a threshold value in the second embodiment.

FIG. 10 is a flowchart to determine abnormality of the compressor according to the discharge temperature. Since the discharge temperature is obtained by directly measuring the temperature of compressed air, the discharge temperature reacts more sensitively to a change in pressure than when heat transfer is measured in the first embodiment. For this reason, the flow is more simplified than measuring the temperature of the compressor, and is a flow in which the pressure is acquired at step 1001, the threshold value is determined from a threshold value map at step 1002, and a determination on temperature abnormality is performed at step 1003.

Third Embodiment

Figure 11:
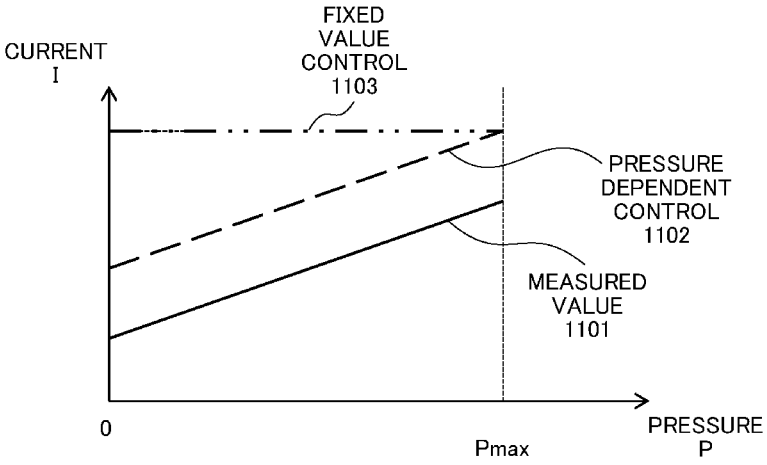
FIG. 11 is a schematic graph in which a threshold value is added to a relationship between pressure and current in a third embodiment.

FIG. 11 shows a method by measuring a current value when pressure changes. Since the current value input into the motor is power used to compress gas, when the pressure increases, the current value also increases. Therefore, when a current value I acquired from the ammeter (not shown) provided in the inverter 107 exceeds a threshold value I(P), the control unit 110

A method for determining a threshold value I(P) of 1102 corresponding to the pressure P is represented by equation (10) where the threshold value is a value obtained by adding a constant value to a normal current value Io(P) of 1101, equation (11) where the threshold value is expressed as a function of the pressure P using the arbitrary coefficients m and β, or the like, and more generally, may be represented by equation (12).

$$I(P)=Io(P)+\alpha \tag{10}$$

$$I(P)=mP+\beta \tag{11}$$

$$I(P+\Delta P)\geq I(P)(\Delta P>0) \tag{12}$$

Figure 12:
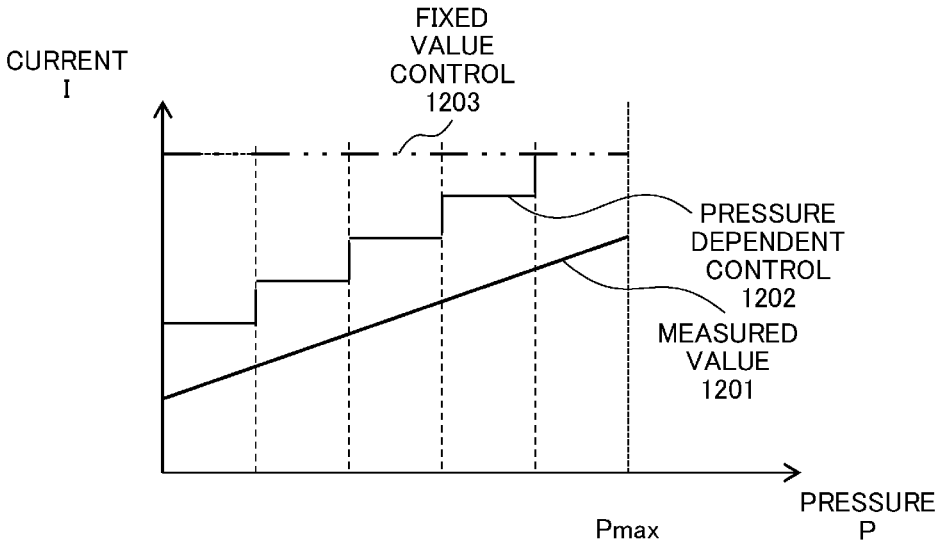
FIG. 12 is a schematic graph in which a threshold value is added to the relationship between pressure and current in the third embodiment.

In FIG. 12, the method for determining the threshold value shown in FIG. 11 is simplified similar to FIG. 3. In the method for determining the threshold value shown in FIG. 12, the pressure is divided into ranges, and the threshold value is set to a constant threshold value for each range as indicated by 1202. A threshold value 1202 is larger than the value of a normal current 1201. When the range is divided, the size of the range may be divided according to a portion even in a certain range. In addition, the number of divisions is also arbitrary.

Figure 13:
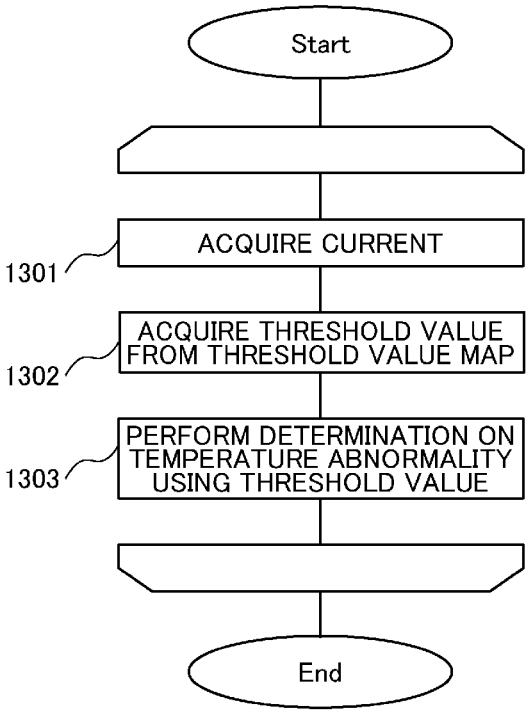
FIG. 13 is a sequence chart to determine a threshold value in the third embodiment.

FIG. 13 is a flowchart to determine abnormality of the compressor according to the current value. Since the current value is directly affected by compressed air, the current value reacts more sensitively to a change in pressure than when heat transfer is measured in the first embodiment. For this reason, the flow is more simplified than measuring the temperature of the compressor, and is a flow in which the pressure is acquired at step 1301, the threshold value is determined from a threshold value map at step 1302, and a determination on abnormality is performed at step 1303.

Fourth Embodiment

Figure 14:
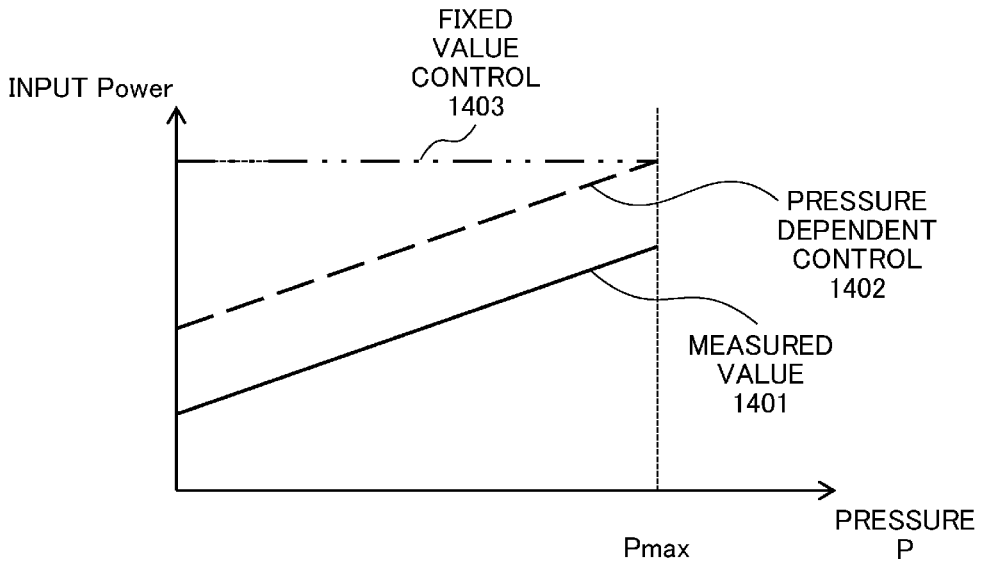
FIG. 14 is a schematic graph in which a threshold value is added to a relationship between pressure and power in a fourth embodiment.

FIG. 14 shows a method by measuring an input power value when pressure changes. The input power value is a value dependent on the pressure similar to the third embodiment, and when the pressure increases, the input value also increases. A method for determining a threshold value W(P) of 1402 corresponding to the pressure P is represented by equation (13) where the threshold value is a value obtained by adding a constant value to a normal input value Wo(P) of 1401, equation (14) where the threshold value is expressed as a function of the pressure P using the arbitrary coefficients m and β, or the like, and more generally, may be represented by equation (15).

$$W(P)=Wo(P)+\alpha \tag{13}$$

$$W(P)=mP+\beta \tag{14}$$

$$W(P+\Delta P)=W(P)(\Delta P>0) \tag{15}$$

Figure 15:
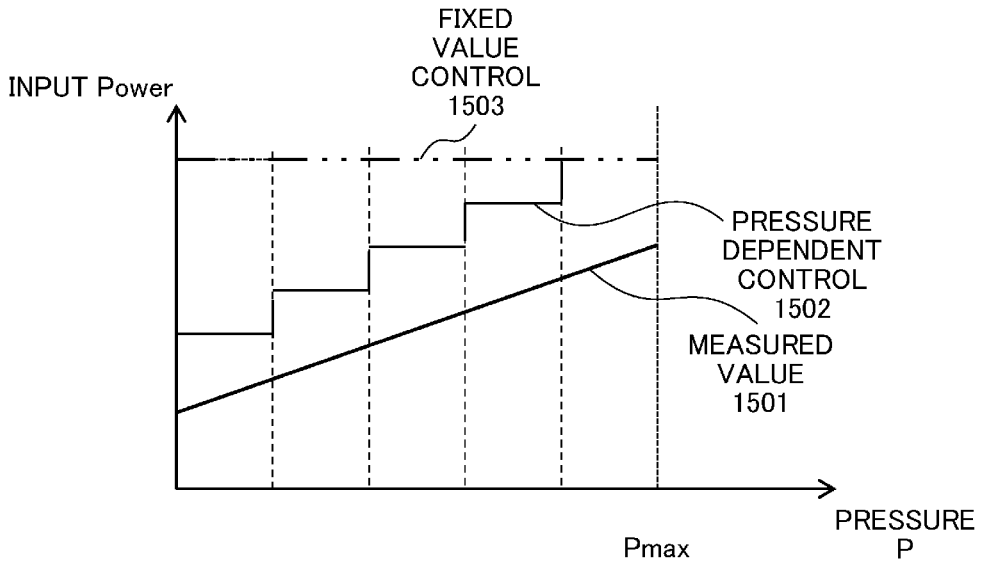
FIG. 15 is a schematic graph in which a threshold value is added to the relationship between pressure and power in the fourth embodiment.

In FIG. 15, the method for determining the threshold value shown in FIG. 14 is simplified similar to FIG. 3. In the method for determining the threshold value shown in FIG. 15, the pressure is divided into ranges, and the threshold value is set to a constant threshold value for each range as indicated by 1502. A threshold value 1502 is larger than the value of a normal input power 1501. When the range is divided, the size of the range may be divided according to a portion even in a certain range. In addition, the number of divisions is also arbitrary.

Figure 16:
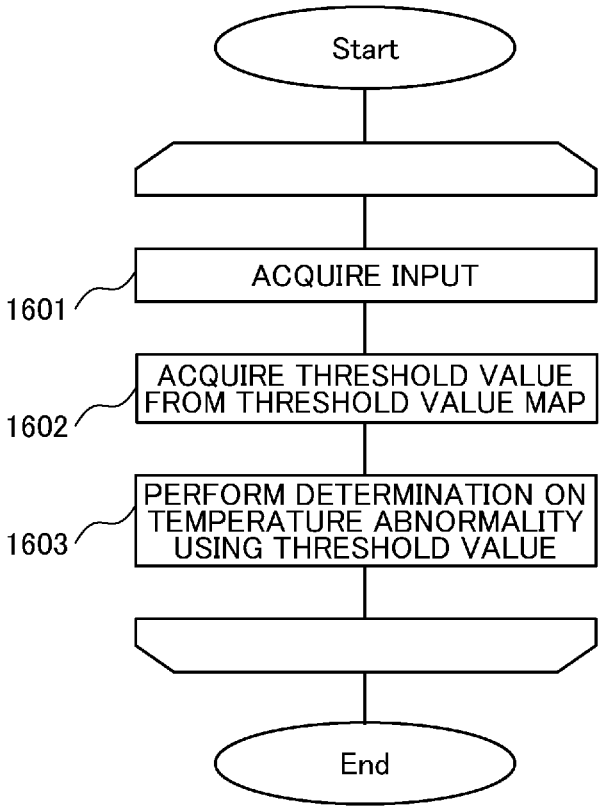
FIG. 16 is a sequence chart to determine a threshold value in the fourth embodiment.

FIG. 16 is a flowchart to determine abnormality of the compressor according to the input value. Since the input value is obtained by directly measuring compressed air, the input value reacts sensitively to a change in pressure. For this reason, the flow is more simplified than measuring the temperature of the compressor, and is a flow in which the pressure is acquired at step 1601, the threshold value is determined from a threshold value map at step 1602, and a determination on abnormality is performed at step 1603.

Incidentally, equations (3), (6), (9), (12), and (15) use an equation such as a quadratic function and an exponential function according to a distribution of the normal temperature, current, or power, or a value that matches the tendency of equations (3), (6), (9), (12), and (15) stored in a storage unit can be also used.

Incidentally, in the present invention, a scroll compressor has been described as an example; however, the present invention is not limited to the scroll machine, and can be adopted in a fluid machine such as a twin or single screw type, a reciprocating type, or a turbo type as long as the fluid machine includes a temperature sensor that measures the temperature of a fluid machine body or a discharge fluid, and a sensor that measures a current or a power input into a motor. In addition, the present invention can be also adopted in compressors such as a compressor that compresses a mixed gas such as air and a compressor that compresses a single gas such as nitrogen gas or oxygen gas. Further, the present invention can be adopted in a fluid machine such as a chiller or a pump including the same mechanism other than the compressor.

In addition, the present invention is not limited to the above embodiments, and includes various modification examples. For example, the above embodiments have been described in detail to describe the present invention in an easy-to-understand manner, and the present invention is not necessarily limited to including all the configurations described. In addition, a part of the configuration of an embodiment can be replaced with the configuration of another embodiment, and the configuration of another embodiment can be added to the configuration of an embodiment. In addition, other configurations can also be added to, removed from, or replaced with a part of the configuration of each of the embodiments. It is needless to say that even when the temperature of the discharge fluid in the second embodiment, an input current to the motor in the third embodiment, or the power consumption of the motor in the fourth embodiment is used, similar to the first embodiment, control is performed such that a notification is not issued when the threshold value is exceeded during start of the fluid machine as described with reference to FIG. 5, or the threshold value can be changed based on the frequency of the output voltage of the inverter.

REFERENCE SIGNS LIST

103 Shaft
104 Orbiting scroll
105 Fixed scroll
106 Cooling fan
107 Inverter
108 Temperature sensor
109 Temperature sensor

The invention claimed is:

1. A compressor comprising:

a compressor body having a motor and a compression mechanism driven by the motor;

a cooling fan that is disposed on the non-load side of the motor, and that cools the compression mechanism;

a temperature sensor that measures a temperature of the compressor body; and a control unit that controls the compressor body, wherein the control unit issues a notification when the temperature measured by the temperature sensor exceeds a temperature threshold value, and changes the temperature threshold value of the temperature sensor to a second threshold value that is lower than the first threshold value in a region where the rotation speed of the cooling fan is high, increases the temperature threshold value when the pressure of the compressed gas discharged from the compressor body increases, and immediately increases the temperature threshold value when increasing the temperature threshold value, and decreases the temperature threshold value in a stepwise manner when decreasing the temperature threshold value.

2. The compressor according to claim 1, wherein when the frequency for driving the compressor body is equal to or higher than a predetermined value, the control unit determines that the rotation speed is in a region that is higher than another region, and changes the temperature threshold value to the second threshold value.

3. The compressor according to claim 2, wherein the compression mechanism is mounted on the load side of the motor.

4. The compressor according to claim 2, wherein the control unit does not issue the notification that the temperature measured by the temperature sensor exceeds the temperature threshold value for a predetermined time after the compressor body restarts operation.

5. The compressor according to claim 2, wherein the temperature sensor is attached to a cooling fin of the compression mechanism.

6. The compressor according to claim 1, wherein the compression mechanism is mounted on the load side of the motor.

7. The compressor according to claim 1, wherein the control unit does not issue the notification that the temperature measured by the temperature sensor exceeds the temperature threshold value for a predetermined time after the compressor body restarts operation.

8. The compressor according to claim 1, wherein the temperature sensor is attached to a cooling fin of the compression mechanism.

9. The compressor according to claim 1, wherein a number of revolutions of the cooling fan and a number of revolutions of the motor are the same.

* * * * *